US007497090B2

(12) United States Patent
Lee et al.

(10) Patent No.: US 7,497,090 B2
(45) Date of Patent: Mar. 3, 2009

(54) AIR CONDITIONER

(75) Inventors: Sang Hun Lee, Gimhae-si (KR); In Hee Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 594 days.

(21) Appl. No.: 11/148,187

(22) Filed: Jun. 9, 2005

(65) Prior Publication Data

US 2005/0279120 A1 Dec. 22, 2005

(30) Foreign Application Priority Data

Jun. 11, 2004 (KR) ..... 10-2004-0042819

(51) Int. Cl.
*F25D 17/06* (2006.01)

(52) U.S. Cl. ..... 62/426; 415/53.1; 415/143; 416/175

(58) Field of Classification Search ..... 62/82, 62/404, 407, 419, 256, 426; 415/53.1, 143; 416/175
See application file for complete search history.

(56) References Cited

U.S. PATENT DOCUMENTS 5,867,994 A * 2/1999 Kopko ..... 62/82
6,560,968 B2 * 5/2003 Ko ..... 62/3.2
2004/0003617 A1 * 1/2004 Chandler et al. ..... 62/256

FOREIGN PATENT DOCUMENTS

| | | | |
|---|---|---|---|
| JP | 10-274425 | A | 10/1998 |
| JP | 2001-324169 | A | 11/2001 |
| JP | 2002-5472 | A | 1/2002 |
| JP | 2003-74902 | A | 3/2003 |
| JP | 2003-343875 | A | 12/2003 |
| JP | 2004-156880 | A | 6/2004 |

OTHER PUBLICATIONS

Machine generated translation of 2001-324169, Nov. 22, 2001.*
Machine generated translation of 2004-156880, Jun. 6, 2004.*

* cited by examiner

*Primary Examiner*—William E Tapolcai
(74) *Attorney, Agent, or Firm*—Birch, Stewart, Kolasch & Birch, LLP

(57) ABSTRACT

An indoor unit for an air conditioner capable of performing cooling and heating, as well as ventilation functions as a single unit is provided. The indoor unit includes a main chassis, a ventilation port, a cross-flow fan, a side fan, and a ventilation duct. The main chassis is installed on a mounting portion and composing its exterior. The ventilation port formed to pass through the main chassis for inletting and exhausting air. The cross-flow fan is installed on one side of the main chassis to blow air in a direction perpendicular to its rotating shaft. The side fan is formed next to the cross-flow fan. The ventilation duct is connected to the ventilation port of the main chassis to ventilate the air forcibly blown by the side fan.

22 Claims, 6 Drawing Sheets

AIR CONDITIONER

BACKGROUND OF THE INVENTION

1. Field of the Invention

The present invention relates to an air conditioner, and more particularly, to an indoor unit for an air conditioner with an added ventilation feature. More specifically, the present invention relates to a wall mount air conditioner unit that offers users a new level of freshness via an additional ventilation feature.

2. Description of the Related Art

An air conditioner is a device for maintaining optimized inside air according to purpose. For example, in the case where inside air becomes high temperature in summer, the air conditioner blows wind of low temperature to cool down the inside. On the contrary, in winter, the air conditioner blows warm wind of high temperature to heat the inside air. Other features of air conditioners include humidity control of interior air, and recently encompasses a variety of features, such as interior air purification.

The air conditioners are roughly divided into an integral type and a separation type. An integral type air conditioner has one unit as a whole and a separation type air conditioner separately has an indoor unit installed inside a space that needs air-conditioning and an outdoor unit installed in the outside. Particularly, recently, a separation type air conditioner is widely used considering noise and installation environment of an air conditioner.

FIG. 1 is an exploded perspective view of a separation type air conditioner of a related art and FIG. 2 is a view illustrating air is sucked into and discharged from an indoor unit of a separation type air conditioner of a related art.

Referring to the drawings, a main chassis 1 forms a frame of an indoor unit. The main chassis 1 has a front panel 3 formed on a front side thereof to form the outer appearance of the indoor unit. The main chassis 1 having the front panel 3 is mounted on a wall in the inside.

A space in which parts that will be described below are mounted is formed between the main chassis 1 and the front panel 3.

In the meantime, the outer appearance of the indoor unit formed by the main chassis 1 and the front panel 3 is protruded toward the front side as a whole as illustrated in FIG. 1.

A suction panel 7 having a front suction grill 5 is provided on the front of the front panel 3 to form a front appearance of the indoor unit. A hinge member (not shown) is provided at the upper end of the suction panel 7 to allow the suction panel 7 to rotate.

The front suction grill 5 is a path through which air sucked from a space that needs air-conditioning is sucked into the inside of the indoor unit. The front suction grill 5 is integrally formed with the suction panel 7. In the meantime, an upper suction grill 3' is formed long left and right on the upper side of the front panel 3. The upper suction grill 3' is integrally formed with the front panel 3 or separately formed.

A heat exchanger 9 is installed at the back of the front panel 3. The heat exchanger 9 allows air sucked through the front suction grill 5 and the upper suction grill 3' to exchange heat while passing through the exchanger 9. A filter 9' for purifying sucked air is installed on the front of the heat exchanger 9.

A cross-flow fan 10 is installed at the back of the heat exchanger. The cross-flow fan 10 sucks air from a space that needs air-conditioning and discharges air back to the space that needs air-conditioning. A fan motor 10' for providing rotational power to the cross-flow fan 10 is installed on the right side of the cross-flow fan 10 and a member for guiding flow created by the cross-flow fan 10 is further integrally formed in the inside of the main chassis 1.

In the meantime, air that has heat-exchanged while passing through the heat exchanger 9 is discharged to a space that needs air-conditioning through the cross-flow fan 10. For that purpose, a discharge grill 11 is installed at the lower end of the main chassis 1 and the front panel 3.

In the meantime, a discharge port 13 for guiding air that has passed through the cross-flow fan 10 to a space that needs air-conditioning is formed in the inside of a discharge grill 11.

A vane 15 for vertically controlling the direction of discharged air and a louver for horizontally controlling the direction of discharged air are installed in the inside of the discharge port 13. The louver 16 is provided in plurals and the louvers 16 are connected to each other by a link 17 to operate simultaneously.

Also, a display part 19 for displaying an operation state of an air conditioner is provided at an about center on the lower portion of the front panel 3.

Description will be made for the air conditioner having the above-described construction and operating in a cooling mode.

When the air conditioner operates, air for air-conditioning is sucked into the inside of an indoor unit by the cross-flow fan 11. That is, air is sucked into the inside of the indoor unit through the front suction grill 5 and the upper suction grill 3' to pass through the heat exchanger 9.

The air that has passed through the heat exchanger 9 exchanges heat with working fluid flowing in the inside of the heat exchanger 9.

The air that has exchanged heat with the heat exchanger 9 becomes relatively low temperature and is sucked into the cross-flow fan 10. The air sucked into the cross-flow fan 10 is discharged to the lower direction and guided to the side of the discharge port 13.

The air guided to the inside of the discharge port 13 changes a discharging direction thereof using the vane 15 and the louver 16 installed inside the discharge port 13 and is discharged to a space that needs air-conditioning through the discharge grill 13. At this point, since the vane 15 and the louver 16 allow the discharged air to be distributed vertically and horizontally, the air is uniformly discharged to the space that needs air-conditioning.

To fix the heat exchanger 9, a fixing bracket 8 is provided to the left of the main chassis 1 and a fixing end 8' that corresponds to a screw-coupling end 9*a* of the heat exchanger 9 is provided to the right of the main chassis 1. A screw-coupling hole 8" should be punched in the inside of the fixing end 8'.

A receiving groove 8*a* for receiving a left end of the heat exchanger 9 is formed on the front side and the upper side of the fixing bracket 8. Hookers 8*b* for hooking and fixing a left hairpin 9*c* of the heat exchanger 9 are protruded in the inside of the receiving groove 8*a*.

A screw through hole 9*b* that corresponds to the screw-coupling hole 8" is punched in the inside of the screw-coupling end 9*a* of the heat exchanger 9.

The heat exchanger 9 is fixed by fixing the fixing bracket 8 in the left of the main chassis 1 using a screw S. At this point, the receiving groove 8*a* of the fixing bracket 8 is open toward the right side.

When the hairpin 9*c* of the heat exchanger 9 is inserted into the receiving groove 8*a* of the fixing bracket 8, the hairpin 9*c* is hooked at and fixed in the hooker 8*b* of the inside of the receiving groove 8*a*. At this point, the left end of the heat exchanger 9 is fixed first.

After that, the right side of the heat exchanger 9, more specifically, the screw-coupling end 9*a* is closed attached to the fixing end 8' of the main chassis 1 and the screen through hole 9*b* is coupled to the screw-coupling hole 8" using a screw S, so that the heat exchanger 9 is fixed to the main chassis 1.

However, related art indoor units have the following problems.

First, because related art air conditioners cool or heat closed indoor spaces for a long durations, the air confined in the spaces becomes stale. In other words, because air from the outside is not drawn in and interior air is not expelled out, while a desired indoor temperature can be obtained using the air conditioner, clean air cannot. Moreover, a separate ventilation unit needs to be installed to ventilate the stale air. Installing such a ventilator alongside an air conditioner involves added cost and use of additional interior space.

SUMMARY OF THE INVENTION

Accordingly, the present invention is directed to an indoor unit for an air conditioner that substantially obviates one or more problems due to limitations and disadvantages of the related art.

An object of the present invention is to provide an indoor unit for an air conditioner with a built-in ventilation feature.

Another object of the present invention is to provide an indoor unit for an air conditioner that controls room temperature having a ventilation feature built into the indoor unit, to provide an optimal indoor atmosphere.

A further object of the present invention is to provide an indoor unit for an air conditioner that conditions air in terms of temperature and ventilation.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an indoor unit for an air conditioner including: a main chassis installed on a mounting portion and composing the exterior thereof; a ventilation port formed to pass through the main chassis for inletting and exhausting air; a cross-flow fan installed on one side of the main chassis for blowing air in a direction perpendicular to its rotating shaft; a side fan formed next to the cross-flow fan; and a ventilation duct connected to the ventilation port of the main chassis to ventilate the air blown by the side fan.

In another aspect of the present invention, there is provided an indoor unit for an air conditioner including: a main chassis having a ventilation port formed in a passing through manner, for inletting and exhausting air; a ventilation door for selectively opening and closing the ventilation port; a first fan installed on one end of the main chassis for blowing air in a direction perpendicular to its rotating shaft; and a second fan disposed next to the first fan, and using a driving device different from that of the first fan, for blowing air sideways.

In a further aspect of the present invention, there is provided an indoor unit for an air conditioner including: a main chassis having a ventilation port; a ventilation duct connected to the ventilation port and exhausting outdoors; a first fan connected to one end of the main chassis for circulating interior air; and a second fan disposed next to the first fan for ventilating air.

The indoor unit for an air conditioner as described above not only adjusts indoor air temperature, but also provides a convenient ventilation feature that ventilates indoor spaces. Because cooling and heating is in conjunction with ventilation, a user will be able to derive satisfactory air conditioning results in a wide variety of circumstances.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
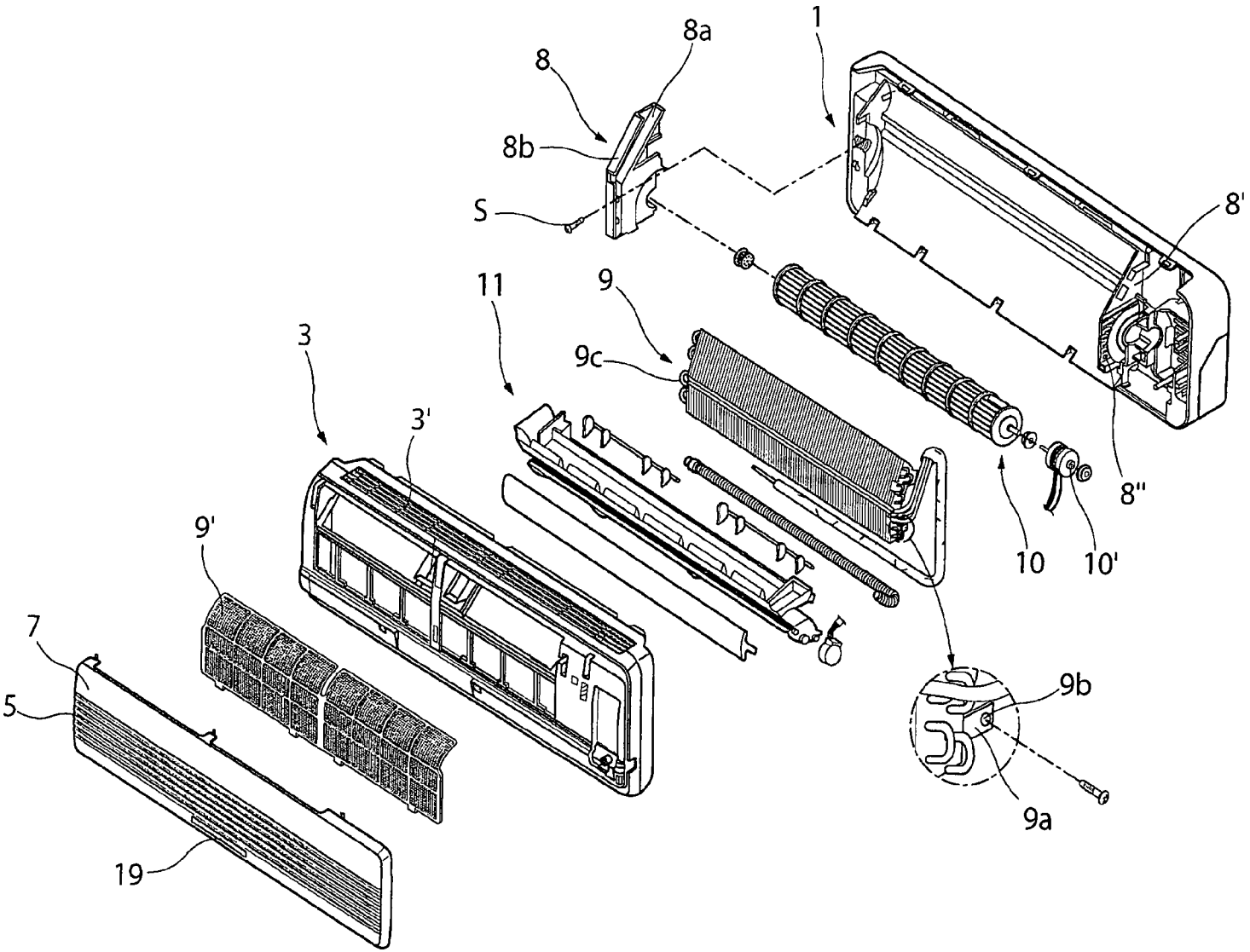
FIG.1(Related art)
FIG. 1 is an exploded perspective view of an indoor unit of an air conditioner according to the related art.
Figure 2:
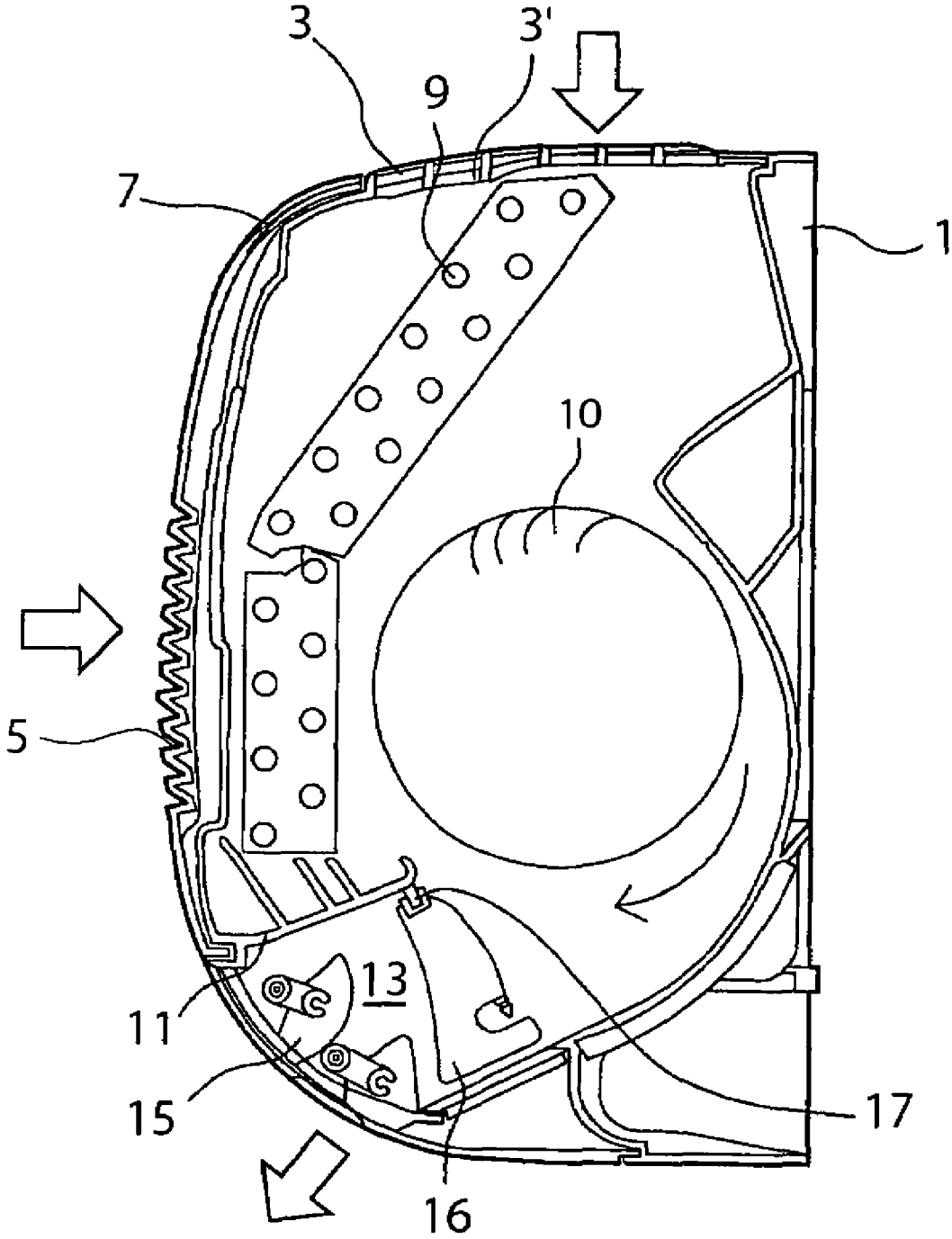
FIG.2(Related art)
FIG. 2 is a side view illustrating an air flow in an indoor unit of an air conditioner according to the related art.
Figure 3:
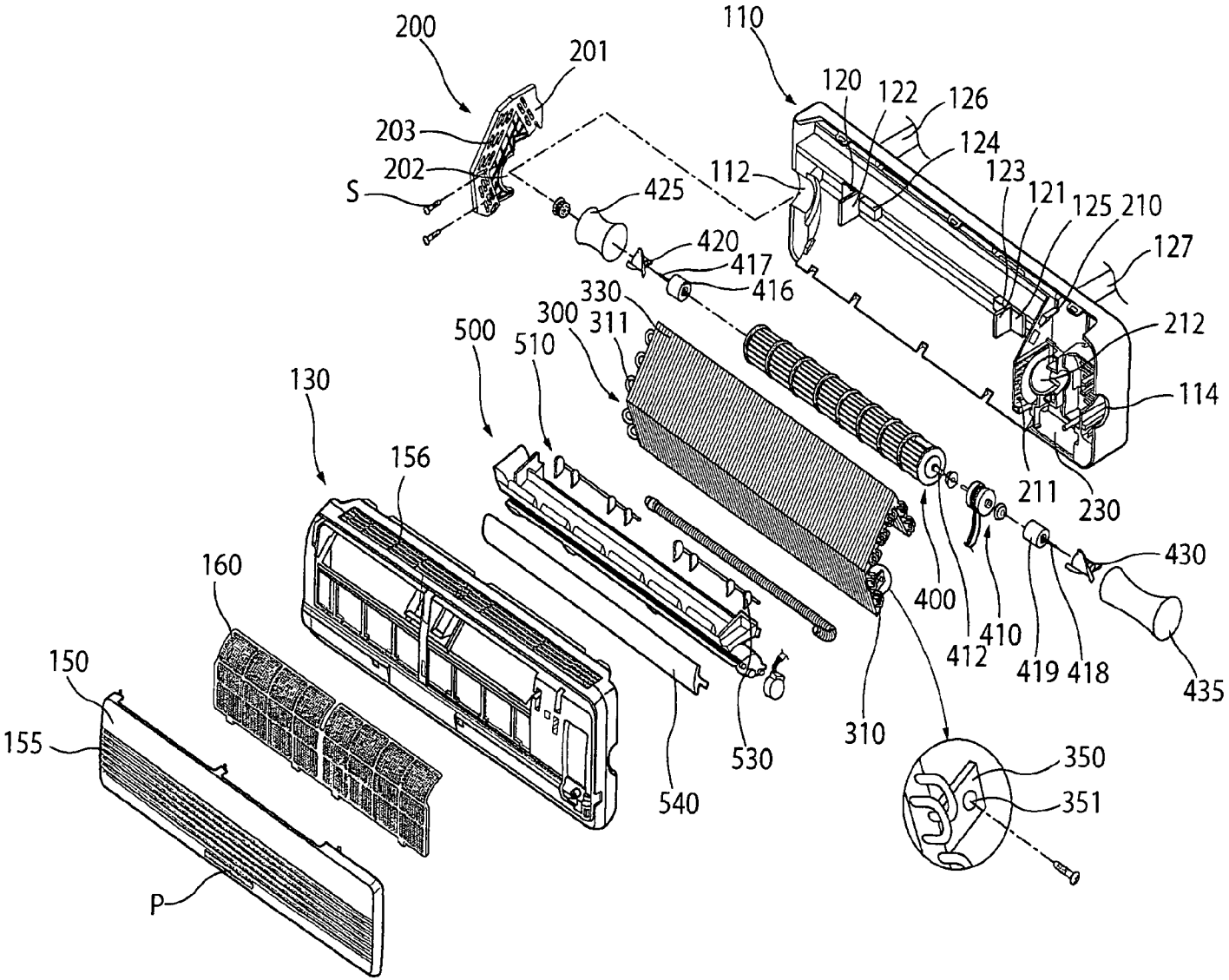
FIG. 3 is an exploded perspective view of an indoor unit of an air conditioner according to the present invention.

FIG. 3 is an exploded perspective view of an indoor unit of an air conditioner of the present invention.

Referring to FIG. 3, the indoor unit of the air conditioner includes a main chassis 110 and a front panel 130, which constitute an appearance.

The main chassis 110 serves as a basic element of the indoor unit of the air conditioner, has a quadrangular space subsiding in a front side thereof, and has a backside fixed on an inside, i.e., a wall surface of a space that needs air-conditioning.

A left discharge hole 112 for guiding air discharged by a left discharge fan 420 that will be described later is formed on the left side of the main chassis 110 and a right discharge hole 114 for guiding air discharged by a right discharge fan 430 that will be described later is formed on the right side of the main chassis 110.

Ventilation ports 120 and 123 are formed in a pair on the main chassis 110 to pass from the front to the rear of the main chassis. That is, the ventilation ports 120 and 123 consist of a left ventilation port 120 and a right ventilation port 123 formed on the respective ends of the main chassis 110.

In addition, disposed respectively at one end of the ventilation ports 120 and 123 are ventilation doors 122 and 121 for selectively opening and closing the ventilation ports 120 and 123. Namely, to the right of the left ventilation port 120 is a left ventilation door 122 formed to open and close over the ventilation port 120, and to the left of the right ventilation port 123 is a right ventilation door 121 formed to open and close over the ventilation port 123. The left and right doors 122 and 121 open and shut by pivoting on a respective hinge (h) formed thereon, and open the ventilation port 120 and 123 during ventilation mode.

Furthermore, ventilation motors 124 and 125 are respectively disposed at the ventilation ports 120 and 123 for providing power to open and close the ventilation doors 122 and 121. Specifically, a left ventilation motor 124 is disposed to the right of the left ventilation door 122 to open and close the same, and a right ventilation motor 125 is disposed to the left of the right ventilation door 121 to open and close the same. In order to open and close the ventilation doors 122 and 121, the ventilation motors 124 and 125 can rotate the hinges (h) on the doors, or a variety of other methods.

Ventilation ducts 126 and 127 extend rearward from the ventilation ports 120 and 123. The ventilation ducts 126 and 127 pass through to the outside of the building from the indoor space. A left ventilation duct 126 is connected to the left ventilation port 120, and a right ventilation duct 127 is connected to the right ventilation port 123. Accordingly, air flows through the ventilation ducts 126 and 127 between the indoor space and the outside.

Parts such as a heat exchanger and a cross-flow fan that will be described later are installed between the main chassis 110 and the front panel 130. In the meantime, the appearance of the indoor unit formed by the main chassis 110 and the front panel 130 is protruded to round on the whole toward the front side as illustrated.

A suction panel 150 having a front suction grill 155 is installed on the front of the front panel 130. The front suction grill 155 is a path through which air sucked from a space that needs air-conditioning is sucked into the inside of the indoor unit. For that purpose, the front suction grill 155 passes through the suction panel 150. Also, an upper suction grill 156 is formed on the upper side of the front panel 130 to allow air of the upper portion of the space that needs air-conditioning to be sucked into the inside of the indoor unit. A filter 160 is provided between the front panel 130 and the suction panel 150. The filter 160 filters air sucked through the front suction grill 155.

A heat exchanger holder 200 for fixing the left of the heat exchanger to the main chassis 110 is fixed at the left end of the inside of the main chassis 110 by a screw (S). A right holder 210 in which the right of the heat exchanger is fixed is protruded on the right of the inside of the main chassis 110.

In detail, the heat exchanger holder 200 includes a frame part 201 to which the left end of the heat exchanger is closely attached and a hairpin guide 203 punched in an edge of the frame part 201. The size and the number of the hairpin guides 203 correspond to a hairpin of the heat exchanger that will be described later.

The frame part 201 serves as a basic element forming the heat exchanger holder 200 and has a predetermined thickness. The reason the frame part 201 is formed to have a predetermined thickness is that the frame part 201 should substantially support the weight of the heat exchanger.

A hairpin guide 203 is punched in the frame part 201. The hairpin guide 203 is a kind of through hole for receiving a fixing the hairpin of the heat exchanger and formed along the outer edge of the frame part 201. The hairpin guide 203 corresponds to the hairpin of the heat exchanger. Therefore, when the heat exchanger has one step or two-step bending shape, the hairpin guides 203 have an about "U" shape.

The heat exchanger holder 200 may be fixed to the main chassis 100 through a screw S as a separate member or may be integrally formed with the main chassis 100. A left guide hole 202 through which air discharged by the left discharge fan 420 passes is formed on the rear end of the heat exchanger holder 200.

The right holder 210 is intended for fixing the right end of the heat exchanger. A coupling hole 211 that corresponds to a through hole of the fixing end of the heat exchanger is punched in one side of the right holder 210. Also, a right guide hole 212 through which air guided by the right discharge fan 430 on the right is formed in a passing through manner on the center of the right holder 210.

A control box seat part 230 on which a control box is installed is formed between the right holder 210 and the right end of the main chassis 100.

In the meantime, the heat exchanger 300 is installed at the rear side of the front panel 130, more specifically, in a space formed between the main chassis 110 and the front panel 130.

The heat exchanger 300 allows air to exchange heat while the air sucked through the front suction grill 155 and the upper suction grill 156 passes therethrough and includes coolant tubes 310 and cooling pins 330.

The coolant tube 310 is a path through which working fluid flowing through a heat exchange cycle, namely, a coolant flows and has the cooling pins 330 fitted therein with a predetermined interval. With such a construction, the coolant flowing through the coolant tube 310 cools down the cooling pin 330. Therefore, the air sucked through the front suction grill 155 and the upper suction grill 156 is cooled down while passing through the cooling pin 330.

In the meantime, the coolant tube 310 runs between left and right of the heat exchanger several times and has an about 'U'-shaped hairpin 311 formed on the end thereof, i.e., the portion returning back to the opposite side. The hairpins 311 are protruded on both sides as the coolant tube 310 runs between left and right several times and inserted into the hairpin guide 203 of the heat exchanger holder 200.

A cross-flow fan 400 is installed in the rear of the heat exchanger 300, more specifically, between the heat exchanger 300 and the main chassis 100.

The cross-flow fan 400 sucks air for air-conditioning and discharges the air downward. That is, the cross-flow fan 400 discharges the heat-exchanged air to the lower direction perpendicular to the rotational axis of the cross-flow fan 400.

Generally, the cross-flow fan has straight-line type wings. That is, since the cross-flow fan has wings bent in the rotational direction, a suction/discharge flow to an axial direction is not generated but suction/discharge flow is generated within a plane perpendicular to the axis of the cross-flow fan.

The cross-flow fan 400 is smaller compared to the width of the heat exchanger 300, and a fan motor 410 to its right provides power to spin the cross-flow fan 400.

A left motor 416 is installed to the left of the cross-flow fan 400 along an imaginary extension of its shaft, and a left fan 420 is installed to the left of the left motor 416. That is, a left motor shaft 417 passes through the center of the left motor 416, and the left fan 420 is installed on the left end of the left motor shaft 417. Accordingly, the left motor 416 provides power to spin the left fan 420. The air in the inside of the indoor unit is discharged to the left side by the left fan 420. The left fan 420 is formed on an imaginary rotational axis of the cross-flow fan 400, so that the inner construction of the air conditioner can be compact even more.

Figure 4:
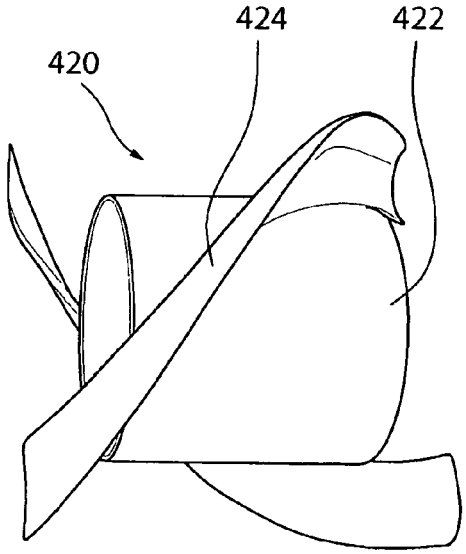
FIG. 4 is a perspective view of a side fan according to the present invention.

FIG. 4 is a perspective view of a side fan according to the present invention. Referring to FIG. 4, it is preferable that the left fan 420 is a shaft-type chi-fan. Specifically, the fan is formed of a cylindrical rotating body 422 and a plurality of fan blades 424 on the outer surface of the rotating body 422. The fan blades 424 spiral helically on the outer surface of the rotating body 422, and push air along an axial direction when rotating.

Referring to FIG. 3, the left fan housing 425 is installed on the outer side of the left fan 420. The left fan housing 425 guides the air forcibly blown by the left fan 420 and has a discharge guide hole (not shown) formed therein horizontally in a passing through manner. The discharge guide hole may have a size that corresponds to the outer diameter of the rotational wing 424 of the left fan 420.

The left fan housing 425 has a cylindrical shape and a center whose diameter is relatively small compared with both side ends. That is, the diameter of the center has a diameter relatively smaller than that of both side ends and is rounded inward.

To the right of the cross-flow fan 400 is installed a right motor 419; and to the right of the right motor 419 is a right fan 430. Specifically, a right motor shaft 418 runs through the center of the right motor 419, with the right fan 430 installed on the right end of the right motor shaft 418. The right fan 430 is a chi-fan as in the explanation given for the left fan 420.

Accordingly, the right motor 419 spins the right fan 430. The rotational force of the right motor 419 is transferred to the right fan 430 through the right motor shaft 418. Through the right fan 430, air is discharged to the inside space from the right side of the unit.

A right fan housing 435 is installed around the right fan 430. The right fan housing 435 is formed similarly to the left fan housing 425 explained previously, and forcibly blows air from the right side of the unit.

The heat exchanged air that passed by the heat exchanger 300 is discharged to the indoor space for air conditioning purposes by the cross-flow fan 400. To this end, a discharge grill 500 is formed at the lower portions of the main chassis 100 and the front panel 130.

Inside the discharge grill 500 a discharge duct 510 is formed for guiding the air conditioning air blown by the cross-flow fan 400 to the indoor space. Also, louvers 530 are formed inside the discharge duct 510 for controlling the direction of the discharged air. The discharge duct 510 is selectively opened and closed by means of discharge vanes 540.

In addition, at the approximate center of the suction panel 150 is disposed a display (P) for displaying the operational status of the air conditioner.

The operation of the indoor unit for an air conditioner will now be explained with reference to FIGS. 3 through 7.

FIGS. 5 through 8 are sectional, horizontal views of an indoor unit for an air conditioner, showing various airflows according to operational mode.

Figure 5:
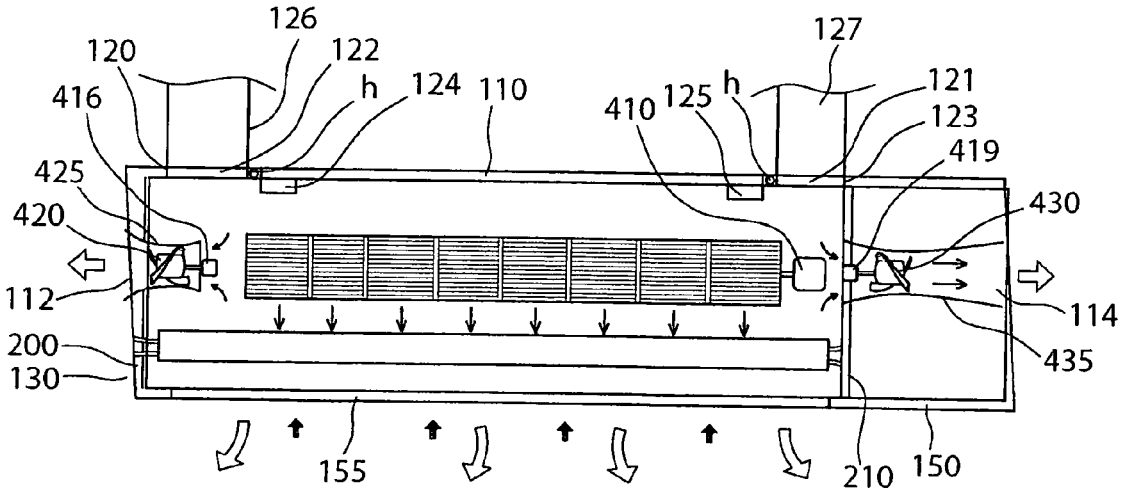
FIG. 5 is a sectional view explaining the airflow of an indoor unit for an air conditioner according to the present invention while the unit operates in air cooling mode.

First, referring to FIGS. 3 and 5, the air conditioner will be described during air cooling mode.

The air conditioner is supplied with power from an external source, which drives the fan motor 410 to spin. The rotational force supplied to the fan motor 410 is relayed via a rotating shaft 412 to a cross-flow fan 400, a left fan 420, and a right fan 430.

When the cross-flow fan 400 and the left and right fans 420 and 430 spin, airflow is created inside the indoor unit of the air conditioner, thereby sucking in air from the outside. That is, outside air is sucked in through a front intake suction 155 and an upper suction grill 156 and proceeds through a heat exchanger 300 to exchange heat.

Air that is cooled by passing through the heat exchanger 300 is guided downward and from the sides by the cross-flow fan 400 and the left and right fans 420 and 430. Specifically, the air guided by the cross-flow fan 400 is discharged downwards from a discharge duct 510 formed at the bottom portion of the main chassis 110, and the air guided by the left fan 420 passes through a left discharge port to be discharged from the left side of the indoor unit, and the air guided by the right fan 430 passes through a right discharge port 114 to be discharged from the right side of the indoor unit.

In still further detail, the air that is sucked in through the front and upper suction grills 155 and 156 to be cooled in the heat exchanger 300 is discharged through the lower and side portions of the indoor unit. That is, a portion of the sucked air is discharged via the cross-flow fan 400 downward, and another portion of the air is discharged via the left and right fans 420 and 430 through left and right portions of the indoor unit.

Additionally, airflow that is forcibly created by the left and right fans 420 and 430 are guided by the left and right fan housings 425 and 435 to be respectively discharged from left and right sides. When the air conditioner functions in the above air cooling mode, the ventilation doors 122 and 121 close the ventilation ports 120 and 123.

The air conditioner functioning in ventilation mode will now be explained.

Figure 6:
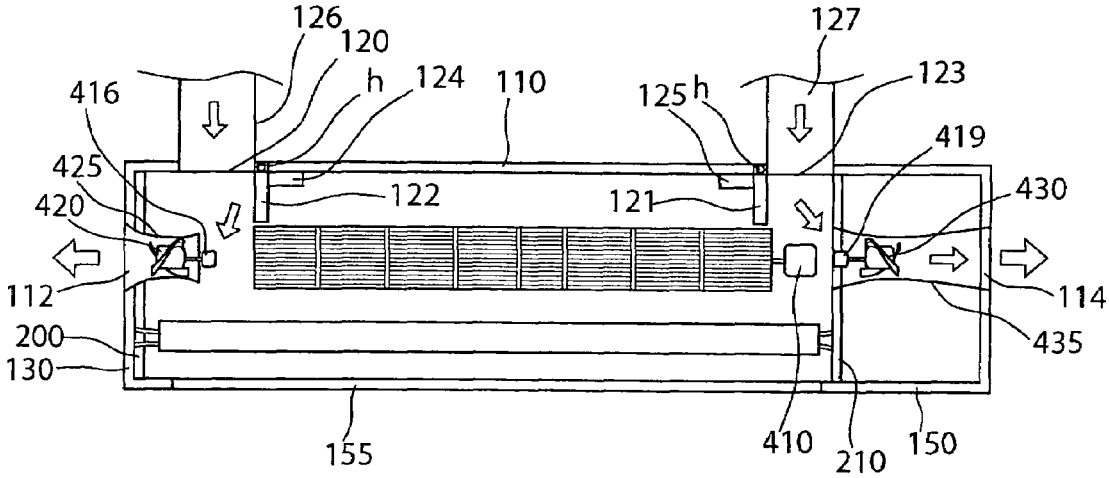
FIG. 6 is a sectional view showing the airflow of an indoor unit for an air conditioner according to the present invention while the unit operates in intake ventilation mode.

Referring to FIG. 6, intake ventilation will be examined. Here, the fan motor 410 does not operate, so the cross-flow fan 400 also does not operate. The left motor 416 spins the left fan 420, and the right motor 419 spins the right fan 430.

The ventilation doors 122 and 121 are opened by the ventilation motors 124 and 125. That is, the doors move on hinges (h) to open in positions perpendicular to the main chassis 110, as shown in the diagram. (FIG. 6 shows the left door 122 opening counter-clockwise and the right door 121 opening clockwise.)

Consequently, air is sucked in from the outside through the ventilation ports 120 and 123, and flows in a left and right direction through the side fans 420 and 430. That is, the air is led through the fan housings 425 and 435 and discharged. Thus, air from the outside is suctioned in and ventilates the indoor space.

Figure 7:
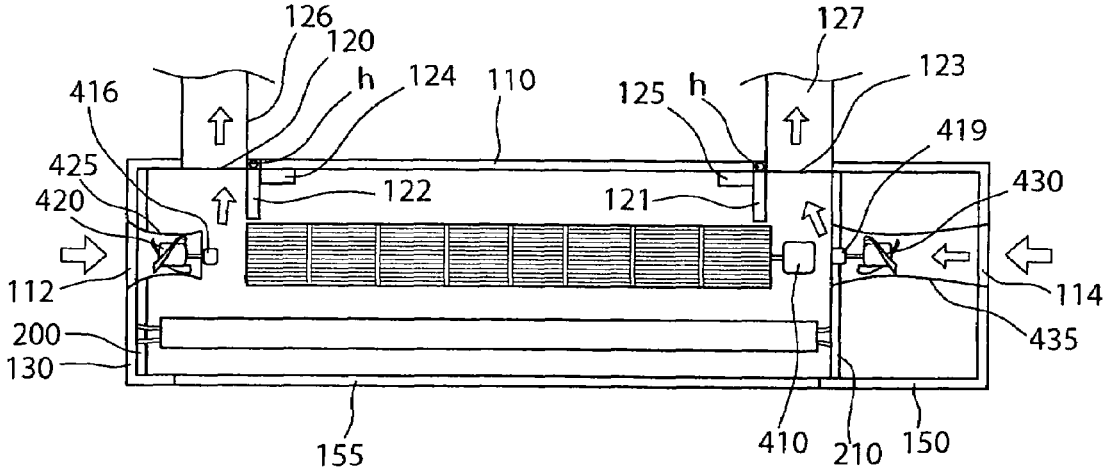
FIG. 7 is a sectional view showing the airflow of an indoor unit for an air conditioner according to the present invention while the unit operates in exhaust ventilation mode.

FIG. 7 shows the air conditioner in exhaust ventilation mode. Here, as in the above-explained intake ventilation mode, the fan motor 410, and thus the cross-flow fan 400 do not operate. The left motor 416 spins the left fan 420, and the right motor 419 spins the right fan 430, and the ventilation doors 122 and 121 are opened. However, the right and left fans 430 and 420 rotate in reverse directions from the intake ventilation mode during the exhaust ventilation mode.

Accordingly, air from the indoor space is suctioned by the left and right fans 420 and 430 through the left and right discharge ports 112 and 114, and is discharged to the outside through ventilation ducts 126 and 127. Thus, the indoor space is ventilated by discharging air within to the outside.

Although the embodiments of the present invention relate to a two-part air conditioning unit, the present invention is not necessarily limited to such applications, and can be varied for use in a wide variety of indoor units.

Also, although the previous embodiment relates to the air conditioner in either intake or exhaust ventilation mode, the two modes do not have to occur separately and can occur simultaneously.

Figure 8:
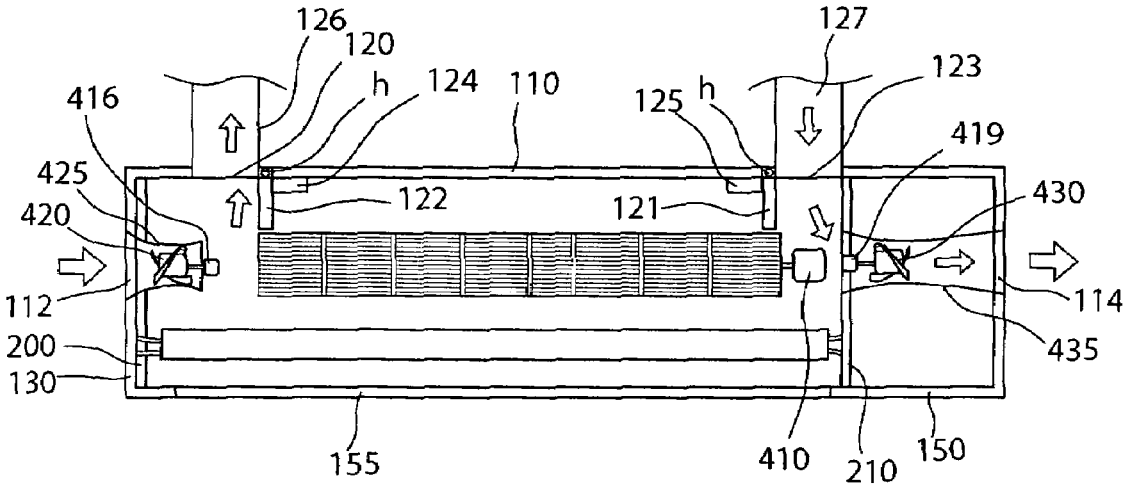
FIG. 8 is a sectional view showing the airflow of an indoor unit for an air conditioner according to the present invention while the unit operates in intake and exhaust ventilation mode.

For a more detailed explanation, if we refer to FIG. 8, one of the two side fans 420 and 430, the left fan 420 can be used as an exhaust fan, and the other, the right fan 430 can be used as an intake fan, so that intake and exhaust functions occur simultaneously.

Here, both of the pair of ventilation doors 122 and 121 are opened, and air from the indoor space is suctioned through the left discharge port 112 into the indoor unit and is discharged through the left ventilation port 120 to the outside. Conversely, air from the outside is suctioned through the right discharge port 123 and is discharged through the right discharge port 114 to the indoor space. Thus, intake and exhaust functions are performed simultaneously to ventilate the interior space.

Furthermore, it is within the scope of the present invention to include an air conditioner that omits the ventilation doors 122 and 121, but has separate ducts for connecting the ventilation ports 123 and 120 to the side fans 420 and 430.

As in the preceding explanation, the indoor unit for an air conditioner according to the present invention has a cross-flow fan inside its central portion and similar fans disposed at either end of the cross-flow fan. Also, the main chassis has a ventilation duct connected to the indoor space, to concentrate components in an effective layout inside a tightly-spaced indoor unit, for cooling and heating as well as ventilating functions.

Also, the present invention allows for not only cooling and heating of air, but also allows a user to selectively ventilate an indoor space by intaking air from the outside or discharging air to the outside.

Additionally, the present invention provides an air conditioner having a variety of functions in a single unit that provides a refreshing indoor environment.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An indoor unit for an air conditioner, comprising:

a main chassis mounted on a mount and composing an exterior of the indoor unit;

a ventilation port formed to pass through the main chassis, for inletting and exhausting air;

a cross-flow fan installed on one side of the main chassis for blowing the air in a direction perpendicular to a rotating shaft of the cross-flow fan;

a side fan formed on a side of the cross-flow fan, the side fan blowing the air in a direction parallel to the rotating shaft of the cross-flow fan; and a ventilation duct connected to the ventilation port of the main chassis, for ventilating the air forcibly blown by the side fan.

2. The indoor unit according to claim 1, wherein the side fan is formed on an imaginary central rotational axis of the cross-flow fan.

3. The indoor unit according to claim 1, wherein the cross-flow fan and the side fan are rotated by separate driving devices, respectively.

4. The indoor unit according to claim 1, wherein the side fan blows the air in a lateral direction of the indoor unit.

5. The indoor unit according to claim 1, wherein the side fan is formed at both sides of the cross-flow fan, respectively.

6. The indoor unit according to claim 1, wherein the main chassis has a rear portion fixed to the mount.

7. The indoor unit according to claim 6, wherein the ventilation port is formed at the rear portion of the main chassis.

8. The indoor unit according to claim 1, wherein outside air sucked in through the ventilation duct is discharged by the side fan to an opening at a lateral side of the main chassis, the opening at the lateral side of the main chassis facing in the direction parallel to the rotating shaft.

9. The indoor unit according to claim 1, wherein the side fan spins clockwise and counterclockwise to move air in different directions.

10. The indoor unit according to claim 1, wherein the side fan blows air in a direction parallel to a rotating central axis of the side fan.

11. The indoor unit according to claim 1, wherein the ventilation port of the main chassis has a ventilation door for selectively opening and closing the ventilation port.

12. The indoor unit according to claim 11, wherein a position of the ventilation door is controlled by a motor.

13. The indoor unit according to claim 1, wherein the ventilation duct is connected to an outside.

14. An indoor unit for an air conditioner comprising:

a main chassis having a ventilation port formed in a passing through manner therein, for inletting and exhausting air;

a ventilation door for selectively opening and closing the ventilation port;

a first fan installed at one end of the main chassis, for blowing the air in a direction perpendicular to a rotating shaft of the first fan; and a second fan disposed next to the first fan, for blowing the air in a direction parallel to the rotating shaft of the first fan.

15. The indoor unit according to claim 14, wherein outside air sucked in through the ventilation duct is discharged by the second fan to an opening at a lateral side of the main chassis, the opening at the lateral side of the main chassis facing in the direction parallel to the rotating shaft of the first fan.

16. The indoor unit according to claim 14, wherein air sucked through the second fan is discharged to an outside through the ventilation duct.

17. The indoor unit according to claim 14, wherein the second fan is disposed at both sides of the first fan, respectively.

18. The indoor unit according to claim 14, wherein the second fan is formed on an imaginary central rotational axis of the first fan.

19. An indoor unit for an air conditioner comprising:

a main chassis having a ventilation port;

a ventilation duct connected to the ventilation port, for communicating with an outside;

a first fan connected to one end of the main chassis, for circulating inside air, the first fan has a rotating shaft; and a second fan disposed next to the first fan, for blowing the air in a direction parallel to the rotating shaft of the first fan to ventilate the air.

20. The indoor unit according to claim 19, wherein the first fan is a cross-flow fan and the second fan is an axial fan.

21. The indoor unit according to claim 19, further comprising a ventilation door for selectively opening and closing the ventilation port.

22. The indoor unit according to claim 19, wherein the main chassis has an opening at a lateral side of the main chassis, the opening at the lateral side of the main chassis facing in the direction parallel to the rotating shaft of the first fan.

* * * * *